US010577921B2

(12) United States Patent
Donderici et al.

(10) Patent No.: US 10,577,921 B2
(45) Date of Patent: Mar. 3, 2020

(54) DETERMINING DOWNHOLE TOOL TRIP PARAMETERS

(71) Applicant: Halliburton Energy Services, Inc., Houston, TX (US)

(72) Inventors: Burkay Donderici, Houston, TX (US); Xiang Tian, Sugar Land, TX (US); Sushovon Singha Roy, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 287 days.

(21) Appl. No.: 15/303,444

(22) PCT Filed: May 12, 2014

(86) PCT No.: PCT/US2014/037710

§ 371 (c)(1),
(2) Date: Oct. 11, 2016

(87) PCT Pub. No.: WO2015/174960

PCT Pub. Date: Nov. 19, 2015

(65) Prior Publication Data

US 2017/0051604 A1 Feb. 23, 2017

(51) Int. Cl.

| | |
|---|---|
| ***E21B 47/09*** | (2012.01) |
| ***E21B 47/04*** | (2012.01) |
| ***E21B 17/20*** | (2006.01) |
| ***E21B 47/12*** | (2012.01) |

(52) U.S. Cl.
CPC ..... *E21B 47/0905* (2013.01); *E21B 17/20* (2013.01); *E21B 47/04* (2013.01); *E21B 47/09* (2013.01); *E21B 47/122* (2013.01)

(58) Field of Classification Search
CPC ..... E21B 17/20; E21B 47/04; E21B 47/09; E21B 47/0905; E21B 47/122
See application file for complete search history.

(56) References Cited

U.S. PATENT DOCUMENTS

| | | | | |
|---|---|---|---|---|
| 5,019,978 | A | 5/1991 | Howard, Jr. et al. | |
| 2005/0269106 | A1* | 12/2005 | Wilson | E21B 23/14 166/381 |
| 2008/0105423 | A1 | 5/2008 | Estes et al. | |
| 2008/0247268 | A1 | 10/2008 | Goodman | |

(Continued)

FOREIGN PATENT DOCUMENTS

WO 2015174960 A1 11/2015

*Primary Examiner* — Caroline N Butcher
(74) *Attorney, Agent, or Firm* — Alan Bryson; Parker Justiss, P.C.

(57) ABSTRACT

Techniques for determining depth of a downhole tool in a wellbore include running a first downhole tool into a wellbore on a downhole conveyance; generating time-dependent logging data with the first downhole tool in the wellbore, at least one of the depth-dependent logging data or the time-dependent logging data associated with an electric or a magnetic property of a wellbore casing or a geological formation; correlating at the first downhole tool the time-dependent logging data with the depth-dependent logging data; and based on the correlation, determining at least one of a depth of the first downhole tool in the wellbore or a speed of the first downhole tool in the wellbore.

23 Claims, 5 Drawing Sheets

(56) References Cited

U.S. PATENT DOCUMENTS

| | | | | |
|---|---|---|---|---|
| 2009/0012710 | A1* | 1/2009 | Van Os | E21B 47/04 702/6 |
| 2013/0255939 | A1* | 10/2013 | Kumaran | E21B 23/00 166/255.1 |

* cited by examiner

DETERMINING DOWNHOLE TOOL TRIP PARAMETERS

CROSS-REFERENCE TO RELATED APPLICATION

This application is the National Stage of, and therefore claims the benefit of, International Application No. PCT/US2014/037710 filed on May 12, 2014, entitled "DETERMINING DOWNHOLE TOOL TRIP PARAMETERS," which was published in English under International Publication Number WO 2015/174960 on Nov. 19, 2015. The above application is commonly assigned with this National Stage application and is incorporated herein by reference in its entirety.

TECHNICAL BACKGROUND

This disclosure relates to systems, methods, and apparatus for determining downhole tool trip parameters (e.g., depth) in a wellbore.

BACKGROUND

In certain downhole operations, little or no communication is available between the tool and control equipment at a terranean surface. As a result, the downhole tool in the wellbore may not be supplied any information about any action needed to be taken at a particular depth in the wellbore. In some cases, knowledge of depth (e.g., exact or estimated) of the downhole tool in the wellbore may be helpful, critical, or even required. In some cases, information from the wellbore may be used to estimate the depth of the downhole tool in the wellbore.

DETAILED DESCRIPTION

The present disclosure relates to determining depth of a downhole tool in a wellbore by, for example, correlating previously gathered depth-dependent logging data to logging data gathered by a downhole tool run into a wellbore in order for depth of the tool to be determined in real-time.

Various implementations of a downhole system and/or apparatus in accordance with the present disclosure may include one, some, or all of the following features. For example, the downhole system may more accurately determine depth of a downhole tool compared to conventional systems that solely rely on temperature and/or pressure measurements, which may not allow precise depth determination. The downhole system may determine a depth of a downhole tool run on a slickline or coiled tubing, or other conveyance that does not facilitate communication of data and/or instructions between the tool and a terranean surface. As another example, the downhole system may determine a depth of the downhole tool in the wellbore without any communication with the surface, which can enable further applications and also improve safety of tool operations.

Figure 1A:
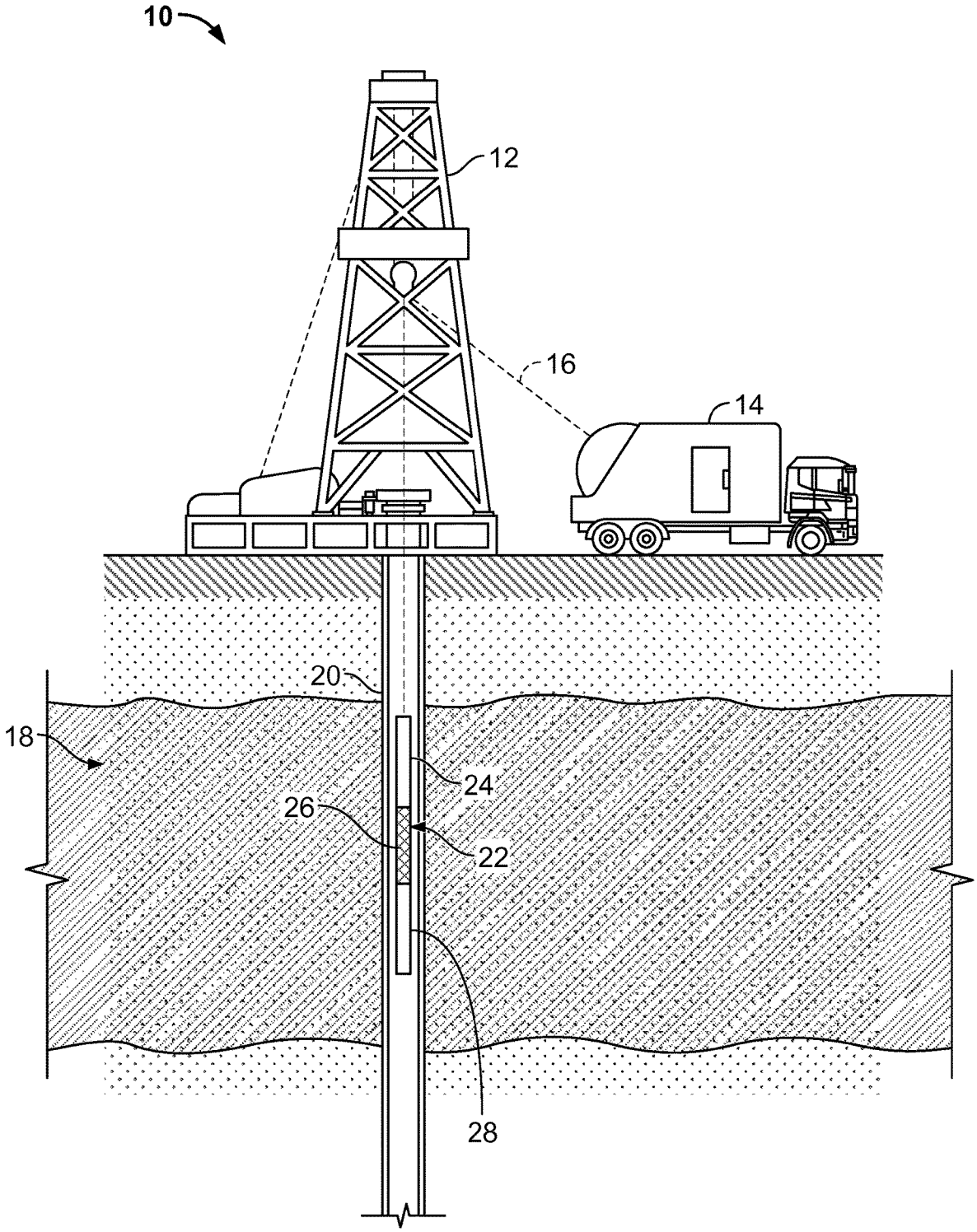
FIG. 1A is a schematic cross-sectional side view of a well system with an example downhole well tool that performs one or more operations based, at least in part, on a depth of the tool in a wellbore.

FIG. 1A illustrates one example of a well system 10 which may utilize one or more implementations of a downhole device in accordance with the present disclosure. Well system 10 includes a drilling rig 12, a conveyance truck 14, a downhole conveyance 16 (e.g., slickline, electric line, coiled tubing, or other conveyance which does not facilitate communication of data and/or instructions thereon), a subterranean formation 18, a wellbore 20, and a downhole tool string 22. Drilling rig 12, generally, provides a structural support system and drilling equipment to create vertical or directional wellbores in sub-surface zones. As illustrated in FIG. 1A, drilling rig 12 may create wellbore 20 in subterranean formation 18. Wellbore 20 may be a cased or open-hole completion borehole. Although shown as a vertical system, the system 10 can include a directional, horizontal, and/or radiussed wellbore, as well as a lateral wellbore system. Moreover, although shown on a terranean surface, the system 10 may be located in a sub-sea or water-based environment. Generally, the wellbore system 10 accesses one or more subterranean formations, and provides easier and more efficient production of hydrocarbons located in such subterranean formations.

Subterranean formation 18 is typically a petroleum bearing formation, such as, for instance, sandstone, Austin chalk, or coal, as just a few of many examples. Once the wellbore 20 is formed, truck 14 may be utilized to insert the downhole conveyance 16 into the wellbore 20. The downhole conveyance 16 may be utilized to lower and suspend one or more of a variety of different downhole tools in the wellbore 20. In some instances, the conveyance 16 may be a tubing string (e.g., coiled) for lowering and suspending the downhole tools in the wellbore 20. In some aspects, the downhole tool string 22 is conveyable into the wellbore 20 on a slickline conveyance or other conductor-less conveyance (e.g., tubing string) that may not facilitate communication of data and/or instructions between the tool and a terranean surface.

The downhole tool string 22 can include one or more tools that may perform operations based, at least in part, on a particular depth (or depths) at which the tool string 22 is lowered. In the present example, tool string 22 may include a downhole tool controller 24 and a downhole tool 28. In some aspects, a downhole tool string also includes a logging tool 32 (e.g., downhole tool 32 as shown and described with reference to FIG. 1B). In some aspects, the controller 24 may be part of the downhole tool 28. The downhole tool controller 24 and downhole tool 28 may be coupled together with a threaded connector 26. In some aspects, the controller 24 may include one or more of a memory (e.g., flash memory or otherwise), a microprocessor, and instructions encoded in software, middleware, hardware, and/or a combination thereof.

Examples of such downhole tools 28 that are communicably coupled with the controller 24 include perforating tools (perforating guns), setting tools, sensor initiation tools, hydro-electrical device tools, pipe recovery tools, and/or other tools. Some examples of perforating tools include single guns, dual fire guns, multiple selections of selectable fire guns, and/or other perforating tools. Some examples of setting tools include electrical and/or hydraulics setting tools for setting plugs, packers, whipstock plugs, retrieve plugs, or perform other operations. Some examples of sensor initiation tools include tools for actuating memory pressure gauges, memory production logging tools, memory temperature tools, memory accelerometers, free point tools, logging sensors and other tools. Some examples of hydro-electrical device tools include devices to shift sleeves, set packers, set plugs, open ports, open laterals, set whipstocks, open whipstock plugs, pull plugs, dump beads, dump sand, dump cement, dump spacers, dump flushes, dump acids, dump chemicals or other actions. Some examples of pipe recovery tools include chemical cutters, radial torches, jet cutters, junk shots, string shots, tubing punchers, casing punchers, electromechanical actuators, electrical tubing punchers, electrical casing punchers and other pipe recover tools.

Another example tool 28 of the tool string 22 may include a neutron generator for pulsed neutron logging. In any event, in some aspects, the operation or operation(s) of the downhole tool 28 may be performed based at least in part on a depth of the tool 28 in the wellbore 20. For example, in some aspects, particular operations (e.g., enabling a neutron generator, firing a perforating gun, and other operation) may be unsafe if performed when the tool 28 is not at a particular depth in the wellbore 20 (e.g., while at the terranean surface). In some aspects, such tools in the tool 28 may be powered using batteries, and the batteries are connected at the terranean surface, making the tool 28 vulnerable to accidental initiation of the operations (e.g., fire of explosives or neutron generator on the surface).

In some examples, temperature and pressure information may be used, at least in part, to prevent accidental operation. For example, the downhole tool 28 may be configured to refrain from performing particular operations (e.g., firing) until a threshold temperature of the tool 28 and/or threshold pressure on the tool 28, as determined by the controller 24.

Figure 1B:
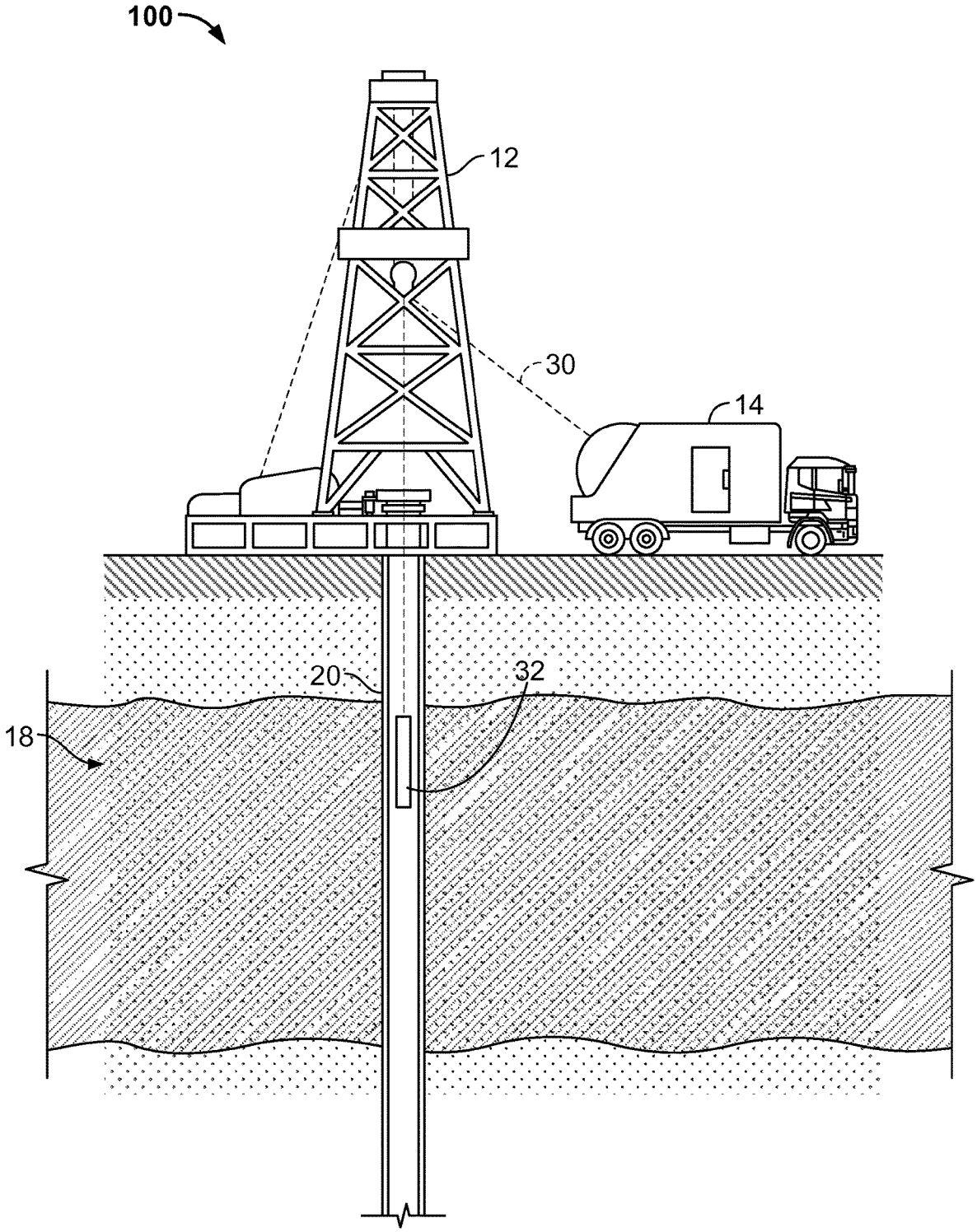
FIG. 1B is a schematic cross-sectional side view of a well system with an example downhole well tool that determines one or more wireline logs.

FIG. 1B illustrates one example of a well system 100 which includes a downhole well tool that determines or collects logging data that is depth-dependent. For example, the logging data may be in the form of signal data vs. wellbore depth and may, in some examples, include wireline logging data, logging while drilling (LWD) data, or other depth-dependent data. Well system 100 includes the drilling rig 12, the conveyance truck 14, a downhole conveyance 30 (e.g., wireline, fiber optic, braided line, or other conveyance which facilitates communication of data and/or instructions thereon), the subterranean formation 18, the wellbore 20, and a downhole tool 32. The downhole conveyance 30 may be utilized to lower and suspend one or more of a variety of different downhole tools in the wellbore 20 for wellbore logging, such as gamma ray logging, CCL logging, or other logging that may correlate depth in the wellbore 20 to a particular measured variable.

In some aspects, operation of the logging tool 32 in well system 100 may be performed prior to operation of the downhole tool string 22 in well system 10. For instance, as explained more fully below, the logging tool 32 may be run into the wellbore 20 to generate one or more logs (or other depth-dependent signal vs. depth data) that are stored in the controller 24 (e.g., in memory or otherwise) of the downhole tool string 22 before the tool string 22 is conveyed into the formation. The wireline logs stored in the controller 24 may subsequently be correlated, by the controller 24, with time-dependent data taken by a tool in the downhole tool string 22 (e.g., logging tool 32 that may be part of the string 22), to estimate and/or determine a depth of the downhole tool 28 in the wellbore 20.

The threshold temperature and/or pressure may be a proxy for a particular depth in the wellbore 20. For example, in some aspects, the downhole tool 28 may be lowered into the wellbore 20 subsequent to a dry run (e.g., a run into the wellbore by a downhole tool that measures temperature and/or pressure vs. depth). The dry run may establish reference levels for temperature and pressure, for example, general measurements of temperature and/or pressure at depth ranges. In some aspects, however, such a technique may not be reliable due to change in the tool 28 or environment. For example, there may be inaccuracies in the reference measurements. Furthermore, the resolution of the depth estimation based on temperature and pressure may have limited resolution since changes in temperature and pressure at short distances may be small. In some aspects, the downhole tool 28 may perform one or more operations based on a depth of the tool 28 as correlated or determined (e.g., in real time during conveyance of the tool string 22 on the conveyance 16) by the controller 24 with reference to one or more wireline logs (e.g., gamma ray, resistivity, casing collar locator (CCL), or other wireline log) developed with the well system 100 shown in FIG. 1B.

Figure 2:
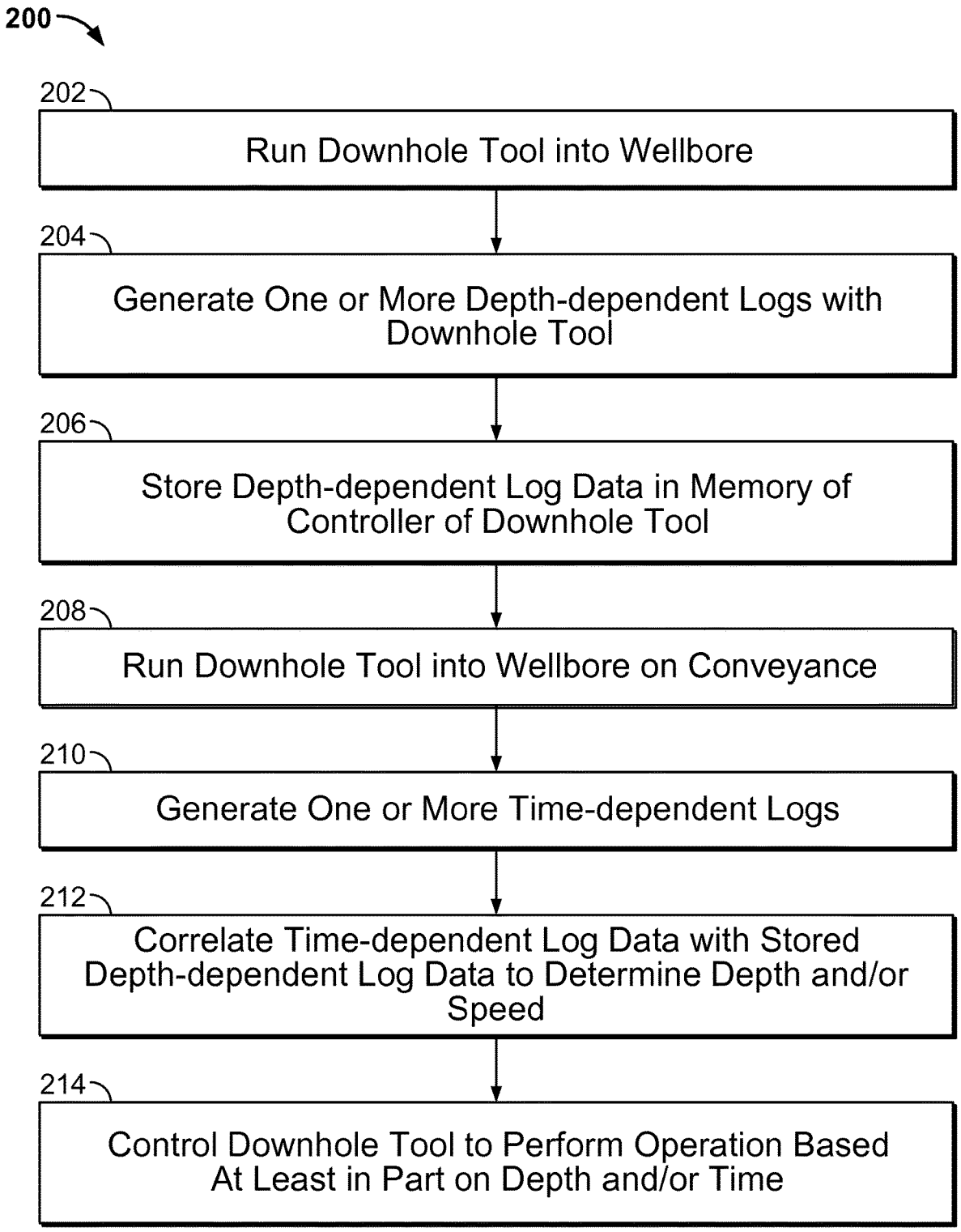
FIG. 2 illustrates an example method for using one or more wireline logs to determine a depth of a downhole tool in a wellbore.

FIG. 2 illustrates an example method 200 for using one or more depth-dependent logs to determine a depth of a downhole tool in a wellbore. In some aspects, method 200 may be implemented, in whole or in part, by one or both of the illustrated systems 10 and 100 (working together or separately). In step 202, a downhole tool, such as, for example, a logging (e.g., wireline or LWD or otherwise) tool (e.g., tool 32) may be run into a wellbore (e.g., wellbore 20). In some aspects, the run-in operation may be performed independently (e.g., solely for the purpose of obtaining wireline logs for subsequent steps of method 200) or may be performed as part of a regular wireline operation where other tools that gather data such as acoustics, resistivity, and other data, are run for general formation evaluation purposes.

In step 204, one or more depth-dependent data logs are generated with the downhole tool. In some aspects, the depth-dependent data is associated with an electric or magnetic property of a wellbore casing or a formation (e.g., a subterranean zone). For example, gamma ray and/or CCL logs may be recorded with respect to depth of the tool in the wellbore. In some aspects, the depth-dependent data is in the form of signal vs. depth data and can be generated by a wireline tool, a LWD tool, or other tool. For example, a wireline tool and/or LWD tool may record and/or communicate gamma ray and/or CCL information with respect to depth. The wireline and/or LWD tool may record such information, for instance, during regular operations where acoustic, resistivity, and/or other tools may be run to collect other formation information.

In some aspects, the depth-dependent data logs may be obtained both in open hole or cased-hole environments, since, for example, gamma ray and CCL logs are relatively less sensitive (e.g., as compared to resistivity logs) to presence of a metal pipe such as the casing. Further, the depth-dependent data logs obtained from wireline or LWD tools may have relatively good depth correlation since depth of the particular tool can be measured from the length of the cable, or length of the pipe that has been lowered. Such depth-dependent data logs can serve as references for correlating depth and time through measured signals.

In step 206, the depth-dependent data logs (e.g., gamma ray and/or CCL data vs. wellbore depth) are stored in memory of a controller (e.g., controller 24) of a downhole tool (e.g., tool 28). In some cases, the downhole tool of step 206 is different than the downhole tool of step 202; in some cases, the tools are the same tool. In some examples, the downhole tool of step 202 is different than the downhole tool of step 206, but each are coupled within a downhole tool string. If different tools are used, storing the depth-dependent data may include storing the data within the controller 24 before the second downhole tool is lowered into the wellbore. If the same tool is used, storing the depth-dependent data log may include processing the measurements from the sensor to generate the depth-dependent data log and storing the depth-dependent data log at the controller 24.

In some aspects, the depth-dependent data logs are comprised of a set of depths, as well as a set of signals associated with each depth (e.g., signal vs. depth). In some aspects, the log data can be stored in compressed format and used with coder/encoders to save memory space in the controller.

In some aspects, as noted above, the wellbore may include casing (e.g., surface casing, conductor casing, intermediate casing, or otherwise). The casing may, in some instances, be installed prior to step 202 or, in other instances, be installed after step 202. For instance, the wireline tool (or tools) may be run in the wellbore several times, for example, one or more times prior to the installation of casing (e.g., to obtain gamma ray logging data) and one or more times subsequent to the installation of casing (e.g., to obtain CCL logging data).

In step 208, the downhole tool (and controller) of step 206 are run into the wellbore on the conveyance (e.g., slickline, coiled tubing, or otherwise), for example, as part of the downhole tool string 22. The downhole tool, in step 208, obtains a time-dependent data log (e.g., during the trip into the wellbore) in step 210. In some aspects, the time-dependent data is associated with an electric or magnetic property of a wellbore casing or a formation (e.g., a subterranean zone). The time-dependent data log (e.g., in the form of signal vs. time) may also be of, for instance, gamma ray data, resistivity data, and/or CCL data. For example, upon acquisition of the signal data, such data is time stamped and stored in the memory along with the depth-dependent data log of step 204.

In some implementations, the time stamp may be based on a clock that is part of the downhole tool. This clock may or may not be synchronized to a universal or uphole clock. For example, clock may have an independent reference frame (e.g., independent of an uphole clock). This clock that provides the time stamp may be connected to the controller in some implementations, because the controller may use the speed or acceleration information to assist mapping of depth-dependent and time-dependent logs.

Figure 3:
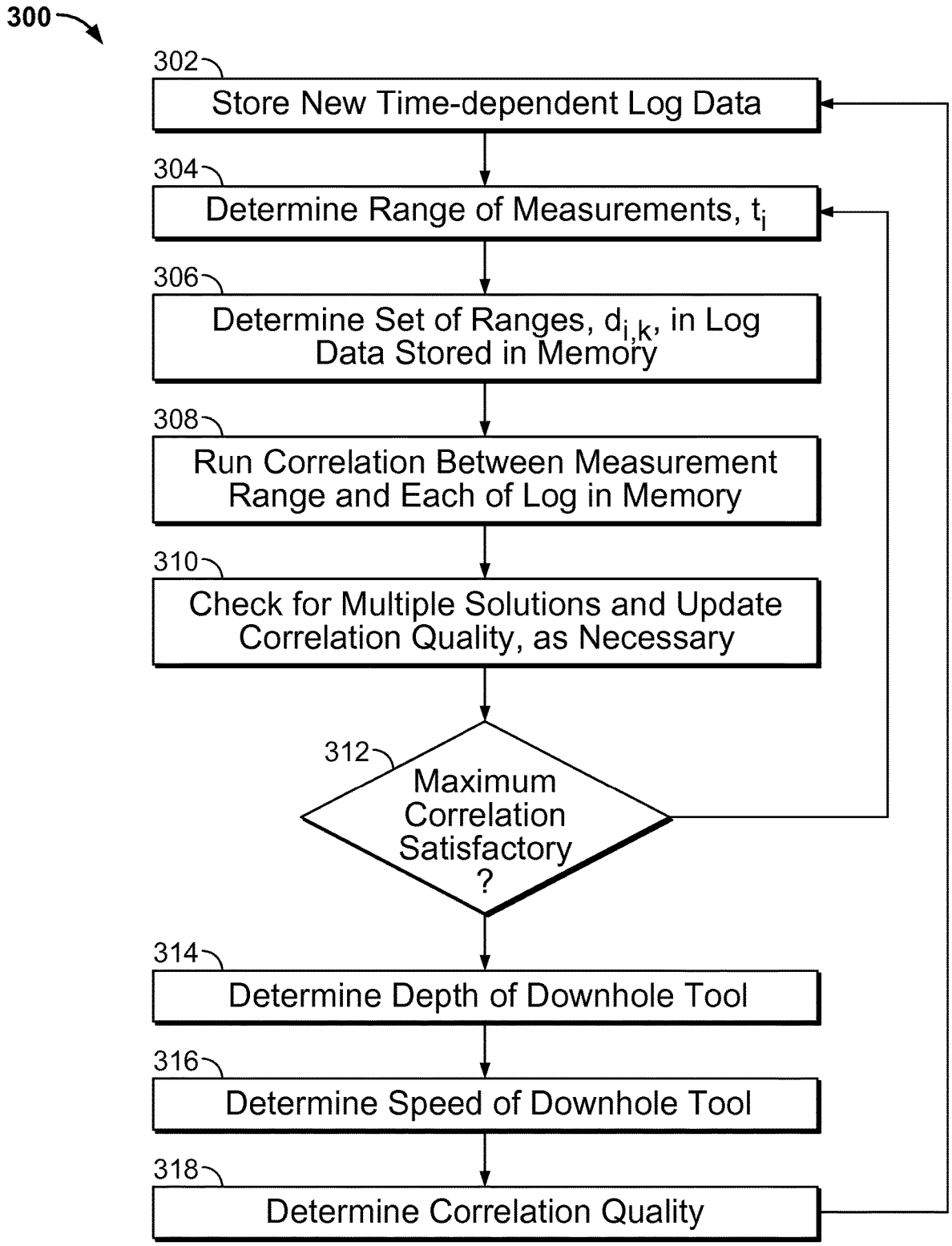
FIG. 3 illustrates an example method for correlating and/or tracking a depth of a downhole tool based on one or more wireline logs.

In step 212, which may occur simultaneous with (e.g., exactly or substantially) steps 208 and 210 (e.g., in real-time with running the downhole tool and controller into the wellbore), the stored depth-dependent data log is correlated (e.g., as shown in FIG. 3) with the time-dependent log data obtained in step 208. For example, since both the depth-dependent and time-dependent data includes the signal data (e.g., gamma, resistivity, and/or CCL signal data) as a function of depth or time, respectively, depth of the downhole tool (as well as other parameters) can be determined based on time of the downhole tool in the wellbore. In some examples, a speed of the downhole tool as it is conveyed in the wellbore may be determined. Further, in some aspects, a correlation quality (e.g., a measurement of the accuracy of speed and/or depth) may be determined.

In step 214, based at least in part on the determined depth or speed (or other parameter), one or more operations may be performed with and/or by the downhole tool. The particular operation may depend, in part, on the type of downhole tool. For instance, if the downhole tool is a neutron generator, operations may include powering on (e.g., when depth of tool is deeper than a particular threshold) or powering off (e.g., when depth of tool is shallower than the particular threshold). As another example, if the downhole tool is a perforating gun, an example operation may be to shoot the gun (e.g., set off the explosives) when a depth of the tool is deeper than a particular threshold or within a particular depth range in or near a subterranean zone.

In some aspects, correlation of the time-dependent data log with the depth-dependent data log (e.g., to determine one or more downhole trip parameters) may be based on a combination of at least two different sets of data, such as, for example, gamma ray and CCL log data. For instance, since gamma ray is not typically run at shallow depth, CCL log data can be used in step 212 to correlate depth of the downhole tool until a particular location in the wellbore (e.g., when the wellbore switches from cased to open-hole or when gamma ray log data becomes available).

Furthermore, alternatively or additionally, wellbore temperature and/or pressure information can also be used in step 212 correlate (or confirm) depth (and other parameters) of the downhole tool in the wellbore. For instance, during step 212, which may be continuously or near-continuously executed as the downhole tool is run into the wellbore, depth-dependent data log signals may not be available at certain depths. Thus, available and stored temperature and/or pressure information may be used. As time-stamped gamma ray or CCL data becomes available in the memory, the correlation and/or tracking in step 212 may use such data to determine depth of the downhole tool.

The step 212 described here can also be implemented with information missing at varying depths (e.g., by extrapolation or interpolation). Furthermore, in some alternative aspects, use of the same gamma ray and CCL tool may be desired to minimize changes between differences in measurements due to differences in tool characteristics or calibration. In some aspects, information may be gathered with different tools in the depth-dependent data gathering steps (e.g., steps 202-204) and time-dependent data gathering steps (e.g., steps 208-210). Moreover, in some aspects, a particular signal log may be substituted for another type (e.g., substitute resistivity for gamma ray).

In some aspects, operation of the downhole tool in step 214 may depend on a correlation quality of the downhole tool trip parameters. For example, in some aspects, if the quality is insufficient (e.g., does not rise to a particular threshold), then certain operations may be disabled and/or other data besides gamma ray, resistivity, and/or CCL data may be used in step 212. For example, in some aspects, if there are gaps in gamma ray and/or CCL data, temperature and/or pressure information may be used in step 212. Furthermore, correlation and tracking can take advantage of temperature and/or pressure information to resolve issues with multiple solutions based on depth-dependent logging data. For example, gamma ray logging data may be identical (e.g., exactly or substantially) at different depths. The correct data can be identified by comparing with information such as temperature or pressure.

FIG. 3 illustrates an example method 300 for correlating and/or tracking a depth of a downhole tool based on one or more wireline logs. In some aspects, method 300 may be implemented, in whole or in part, by one or both of the illustrated systems 10 and 100 (working together or separately). In some aspects, all or part of method 300 may be performed during step 210 of method 200.

In step 302, time-dependent logging data is stored in the downhole tool as it is conveyed into the wellbore (e.g., during steps 208-212). For example, the downhole tool (e.g., of step 206) may be run into the wellbore on a downhole conveyance, such as a slickline or coiled tubing (or other conveyance that does not facilitate communication of data and/or instructions between the tool and the terranean surface). As the downhole tool is run into the wellbore, the tool may take time-dependent data (e.g., gamma ray, CCL, or otherwise). After every new data becomes available during the run in of the downhole tool, it may be stored in the memory (e.g., of the controller) with an associated time stamp on each data. In some aspects, the time-dependent data may be stored in memory alongside the depth-dependent logging data stored in the previous measurements (e.g., in step 206).

In step 304, a range of measurements, $t_i$, is determined. Besides the time stamp, the data can also be given an index for easy access. Here, i, is a sample index i=1, . . . , N. The measurement range may typically include a certain predetermined time interval that includes and immediately precedes the last measurement taken by the data gathering tool. The length of the interval may be chosen to be large enough to avoid multiple solution and tracking issues, and may also be chosen to be small enough to accommodate changes in logging speed. The length can be adjusted dynamically based on the logging speed. For example, for faster speeds, the length may be reduced; for slower speeds, the length may be increased. In some aspects, time stamps of measurements in the range, $t_i$, are chosen to be uniformly distributed. However, in some aspects, different distributions may be chosen to accommodate logging speed variations. In some aspects, an iterative numerical optimization on time range distribution can be run to maximize depth measurement quality factor.

In step 306, a set of ranges, $d_{i,k}$, in the depth-dependent data stored in the memory is determined. Here, i is the sample index i=1, . . . , N, and k=1, . . . , K is a range index. For example, the first time the range is determined, a set of ranges can be chosen to cover all or a large portion of the whole wireline log (or logs). In some aspects, as an initial depth of the downhole tool for the first time, the set of depths can be chosen to include only those that are in the vicinity of the previous successful depth result. Furthermore, in some aspects, an extrapolation may be performed to determine the set of depths based on, for instance, a logging speed and/or a previous depth. Such interpolation and/or extrapolation may reduce a number of combinations that needs to be run and optimizes the runtime of the algorithm. In some aspects, this distribution of depth points can be chosen to be arbitrary or uniform. For example, more points can be placed in depth ranges with more variation, and less number of points can be used in other depth ranges of the wellbore.

In step 308, a correlation is executed between the measurement range and each log in memory. In some aspects, the correlation equations may be as follows:

$$m'(t_i) = m(t_i) - \frac{1}{N}\sum_{i=1}^{N} m(t_i),$$

where $m(t_i)$ is the measurement (e.g., gamma ray, CCL, resistivity, or otherwise) at time, $t_i$;

$$l'(d_{i,k}) = l(d_{i,k}) - \frac{1}{N}\sum_{i=1}^{N} l(d_{i,k}),$$

where $l(d_{i,k})$ is the log data at depth, $d_{i,k}$; and $$C(k) = \frac{\sum_{i=1}^{N} m'(t_i)l'(d_{i,k})}{\left(\sum_{i=1}^{N} m'(t_i)m'(t_i)\right)\left(\sum_{i=1}^{N} l'(d_{i,k})l'(d_{i,k})\right)},$$

C(k) is the correlation value (e.g., quality) for range, k.

In step 310, a check may be made for multiple solutions (e.g., multiple instances) and the correlation quality (e.g., C) may be updated as necessary. For example, in some aspects, there may be multiple maximum correlation quality values that are close to each other in value, but have different (e.g., substantially) corresponding depths.

In step 312, a determination is made whether a maximum correlation quality (e.g., C) meets a threshold value. For example, after correlations for all K ranges are obtained, the depth at which the maximum correlation is obtained is chosen as the measurement depth. If the correlation at that depth is found to be smaller than a particular threshold (or there are multiple maximum correlation quality values that are close to each other in value), then the method 300 may return to step 304, as illustrated in this implementation, and the set of ranges for the log and range for the measurement is updated to resolve the ambiguity starting at step 304. Some solutions to maximize correlation and hence quality are to use a larger number of ranges, K; adjust the ranges to cover more ranges in the areas of maximum correlation; change the number of points in the correlation operation, N; or change the distribution of time or depth points in ranges. In some aspects, changing the distribution of time or depth points in ranges may be useful in cases where a logging speed is changing. For example, when the downhole tool stops, all depth points may have to be taken from the same point to maximize correlation. In addition, when the downhole tool is logging in a direction reverse to the stored depth-dependent data log (e.g., the downhole tool is logging toward the terranean surface while the stored depth-dependent data log was taken toward a bottom hole of the wellbore), the depth points may need to be taken in the reverse order to maximize correlation.

If C does meet the threshold value, then the method 300 proceeds to step 314. In step 314, a depth of the downhole tool is determined. For example, in some aspects, the depth may be determined according to:

$$k_{max} = \arg\max(C(k)).$$

In step 316, a speed of the downhole tool is determined. For example, in some aspects, the speed can be obtained by a velocity calculation from two samples at different depths and times. For instance, in some aspects, the downhole tool speed may be determined according to:

$$\text{speed}\left(\frac{t_{max} + t_{max}^{old}}{2}\right) = \frac{d_{max} - d_{max}^{old}}{t_{max} - t_{max}^{old}},$$

where $d_{max}$ is the depth at time $t_{max}$, $d_{max}^{old}$ is the depth at time $t_{max}^{old}$. Here $d_{max}^{old}$ and $d_{max}$ are subsequent measurements.

In step 318, a correlation quality, C(k), of the final results (e.g., depth and speed and any other downhole tool trip parameters) is determined. The correlation quality value, in some aspects, is a relative measurement or value that is maximized based on the uniqueness of $k_{max}$. For example, in cases where there are multiple C(k)'s that give similar $C(k_{max})$, quality is decreased. In cases there are only very few C(k)'s that give similar results to $C(k_{max})$, quality is increased. Quality can be determined (e.g., from a histogram) by counting the number of cases that are within a given threshold of the $C(k_{max})$ value. For example, quality can be defined as the inverse of number of cases that satisfy $C(k)>C(k_{max})$*threshold, where the threshold may be 0.9.

Figure 4:
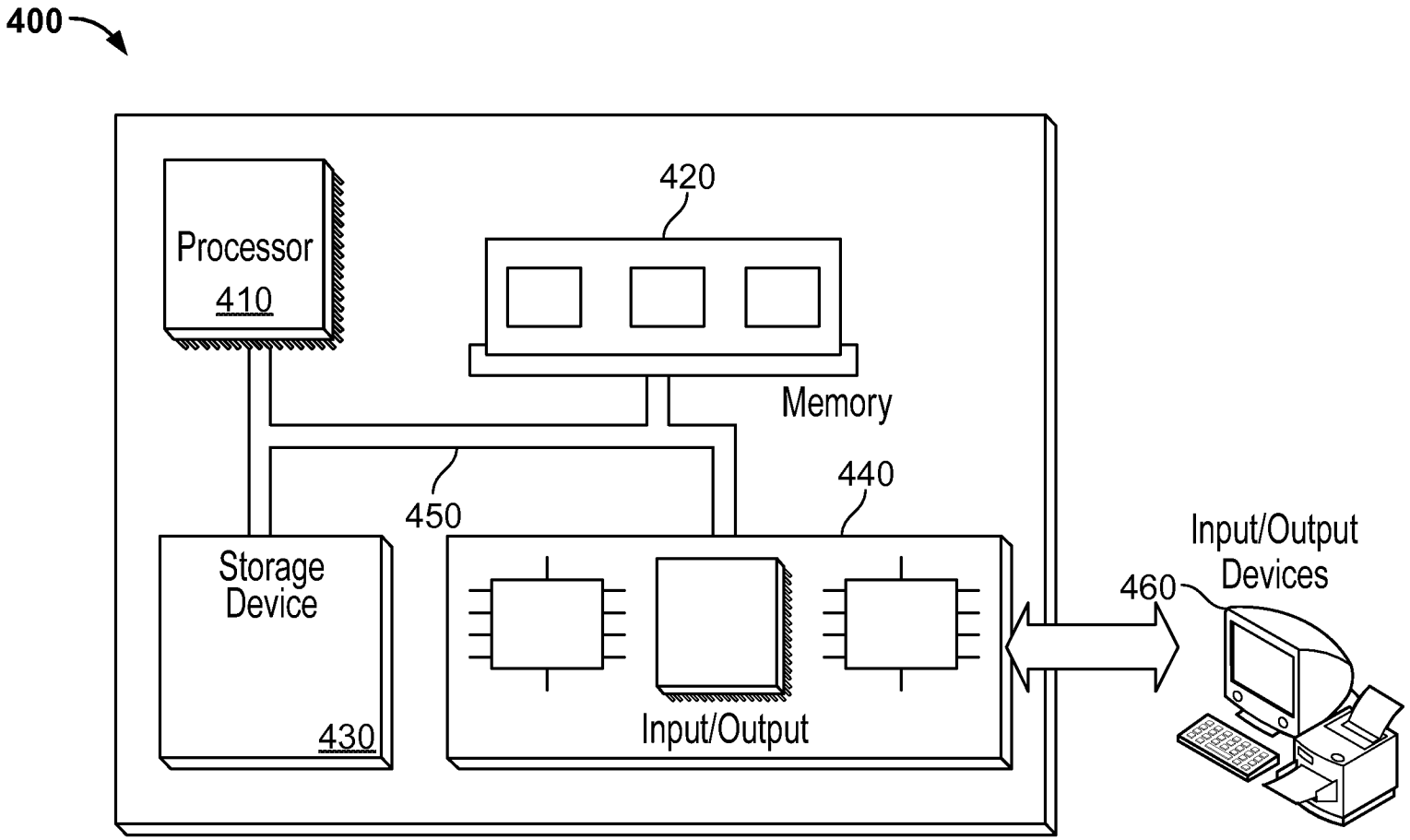
FIG. 4 illustrates a block diagram of an example of a controller on which some examples may operate.

FIG. 4 is a block diagram of an example of a controller 400. For example, referring to FIG. 1A, one or more parts of the controller 24 could be an example of the controller 400 described here. The illustrated controller 400 includes a processor 410, a memory 420, a storage device 430, and an input/output device 440. Each of the components 410, 420, 430, and 440 can be interconnected, for example, using a system bus 450. The processor 410 is capable of processing instructions for execution within the controller 400. In some implementations, the processor 410 is a single-threaded processor. In some implementations, the processor 410 is a multi-threaded processor. In some implementations, the processor 410 is a quantum computer. The processor 410 is capable of processing instructions stored in the memory 420 or on the storage device 430. The processor 410 may execute operations such as those (e.g., all or part) illustrated in FIGS. 2 and 3.

The memory 420 stores information within the controller 400. In some implementations, the memory 420 is a computer-readable medium. In some implementations, the memory 420 is a volatile memory unit. In some implementations, the memory 420 is a non-volatile memory unit.

The storage device 430 is capable of providing mass storage for the controller 400. In some implementations, the storage device 430 is a computer-readable medium. In various different implementations, the storage device 430 can include, for example, a hard disk device, an optical disk device, a solid-date drive, a flash drive, magnetic tape, or some other large capacity storage device. In some implementations, the storage device 430 may be a cloud storage device, e.g., a logical storage device including multiple physical storage devices distributed on a network and accessed using a network. In some examples, the storage device may store long-term data, such as wireline log data or other data. The input/output device 440 provides input/output operations for the controller 400. In some implementations, the input/output device 440 can include one or more of a network interface devices, e.g., an Ethernet card, a serial communication device, e.g., an RS-232 port, and/or a wireless interface device, e.g., an 802.11 card, a 3G wireless modem, a 4G wireless modem, or a carrier pigeon interface. A network interface device allows the controller 400 to communicate, for example, transmit and receive instructions to and from a control system on the terranean surface, when communicably coupled. In some implementations, the input/output device can include driver devices configured to receive input data and send output data to other input/output devices, e.g., keyboard, printer and display devices 460. In some implementations, mobile computing devices, mobile communication devices, and other devices can be used.

A controller can be realized by instructions that upon execution cause one or more processing devices to carry out the processes and functions described above, for example, such as determining and/or correlating a depth of a downhole tool in a wellbore based on one or more wireline logs, controlling a downhole tool to perform one or more operations based on the determined depth, or otherwise. Such instructions can include, for example, interpreted instructions such as script instructions, or executable code, or other instructions stored in a computer readable medium.

The features described can be implemented in digital electronic circuitry, or in computer hardware, firmware, software, or in combinations of them. The apparatus can be implemented in a computer program product tangibly embodied in an information carrier, e.g., in a machine-readable storage device, for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. Elements of a computer can include a processor for executing instructions and one or more memories for storing instructions and data. Generally, a computer can also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

In a general implementation according to the present disclosure, techniques (e.g., methods, systems, apparatus, computer-readable media) for determining depth of a downhole tool in a wellbore include: running a first downhole tool into a wellbore on a downhole conveyance; generating time-dependent logging data with the first downhole tool in the wellbore, at least one of the depth-dependent logging data or the time-dependent logging data associated with an electric or a magnetic property of a wellbore casing or a geological formation; correlating at the first downhole tool the time-dependent logging data with the depth-dependent logging data; and based on the correlation, determining at least one of a depth of the first downhole tool in the wellbore or a speed of the first downhole tool in the wellbore.

In a first aspect combinable with the general implementation, storing depth-dependent logging data in computer-readable memory of a first downhole tool includes receiving the depth-dependent logging data from a second downhole tool In a second aspect combinable with any of the previous aspects, the second downhole tool includes a wireline logging tool or a logging while drilling (LWD) tool.

In a third aspect combinable with any of the previous aspects, the first and second downhole tools either are the same downhole tool or are coupled together in a downhole tool string.

In a fourth aspect combinable with any of the previous aspects, the downhole conveyance includes a conductor-less conveyance.

In a fifth aspect combinable with any of the previous aspects, both of the depth-dependent logging data and the time-dependent logging data are associated with the electric or the magnetic property of the wellbore casing or the geological formation.

In a sixth aspect combinable with any of the previous aspects, each of the depth-dependent logging data and the time-dependent logging data includes at least one of gamma ray logging data, resistivity logging data, or casing collar locator (CCL) logging data.

A seventh aspect combinable with any of the previous aspects further includes prior to running the first downhole tool into the wellbore on the downhole conveyance, running the second downhole tool into the wellbore; and recording the depth-dependent logging data with the second downhole tool.

In an eighth aspect combinable with any of the previous aspects, correlating, with at least one of the first or second downhole tool, the time-dependent logging data with the depth-dependent logging data stored in the memory includes: determining a range of measurements of the time-dependent logging data; comparing, for each range of measurements, values in the time-dependent logging data and values in the depth-dependent logging data; determining, based on the comparison, a correlation quality; based on the correlation quality exceeding a threshold, determining the depth or the speed of the downhole tool in the wellbore.

In a ninth aspect combinable with any of the previous aspects, determining at least one of a depth of the first downhole tool in the wellbore or a speed of the first downhole tool in the wellbore includes determining, in real-time, at least one of a depth of the first downhole tool in the wellbore or a speed of the first downhole tool in the wellbore during the running of the first downhole tool into the wellbore.

A tenth aspect combinable with any of the previous aspects further includes performing at least one operation with the first downhole tool based at least in part on the determined depth or speed of the downhole tool in the wellbore.

An eleventh aspect combinable with any of the previous aspects further includes storing depth-dependent logging data in computer-readable memory of a first downhole tool.

A number of examples have been described. Nevertheless, it will be understood that various modifications may be made. For example, one or more operations described herein (e.g., methods 200 and 300 described in FIGS. 2 and 3, respectively) may be performed with additional steps, fewer steps, in varying orders of operation, and/or with some steps performed simultaneously. Further, although some operations and conveyances may be associated with wireline in the present disclosure, such operations and conveyances may also be performed with other downhole wires that convey data and/or instructions, such as optical fiber, braided line, and other conveyances. Accordingly, other examples are within the scope of the following claims.

What is claimed is:

1. A method for determining depth of a downhole tool in a wellbore, comprising:

running a first downhole tool into a wellbore on a downhole conveyance;

generating depth-dependent logging data associated with a geological formation with the first downhole tool;

storing the depth-dependent logging data from the first downhole tool in computer-readable memory of a second downhole tool;

running the second downhole tool into the wellbore on the downhole conveyance;

generating time-dependent logging data with the second downhole tool in the wellbore;

time stamping the generated time-dependent logging data, wherein at least one of the depth-dependent logging data or the time-dependent logging data associated with an electric or a magnetic property of the geological formation;

correlating at the second downhole tool the time-stamped time-dependent logging data with the depth-dependent logging data; and based on the correlation, determining at least one of a depth of the second downhole tool in the wellbore or a speed of the second downhole tool in the wellbore.

2. The method of claim 1, wherein storing the depth-dependent logging data in the computer-readable memory of the second downhole tool comprises receiving the depth-dependent logging data from the first downhole tool.

3. The method of claim 2, wherein the first downhole tool comprises a wireline logging tool or a logging while drilling (LWD) tool.

4. The method of claim 3, wherein the first and second downhole tools either are the same downhole tool or are coupled together in a downhole tool string.

5. The method of claim 2, further comprising:

prior to running the second downhole tool into the wellbore on the downhole conveyance, running the first downhole tool into the wellbore; and recording the depth-dependent logging data with the first downhole tool.

6. The method of claim 1, wherein the downhole conveyance comprises a conductor-less conveyance.

7. The method of claim 1, wherein both of the depth-dependent logging data and the time-dependent logging data are associated with the electric or magnetic property of the geological formation.

8. The method of claim 7, wherein each of the depth-dependent logging data and the time-dependent logging data comprises at least one of gamma ray logging data or resistivity logging data.

9. The method of claim 1, wherein correlating, with at least one of the first or second downhole tool, the time-dependent logging data with the depth-dependent logging data stored in the memory comprises:

determining a range of measurements of the time-dependent logging data;

comparing, for each range of measurements, values in the time-dependent logging data and values in the depth-dependent logging data;

determining, based on the comparison, a correlation quality; and based on the correlation quality exceeding a threshold, determining the depth or the speed of the second downhole tool in the wellbore.

10. The method of claim 9, wherein determining at least one of a depth of the second downhole tool in the wellbore or a speed of the second downhole tool in the wellbore comprises determining, in real-time, at least one of a depth of the second downhole tool in the wellbore or a speed of the second downhole tool in the wellbore during the running of the second downhole tool into the wellbore.

11. The method of claim 1, further comprising performing at least one operation with the second downhole tool based at least in part on the determined depth or speed of the downhole tool in the wellbore.

12. A system comprising:

a first downhole tool configured to generate depth-dependent logging data associated with a geological formation;

a second downhole tool; and a controller communicably coupled to the second downhole tool, the controller comprising a processor and a memory device that stores depth-dependent logging data generated by the first downhole tool in the wellbore, the memory device storing a set of instructions that when executed by the processor cause the processor to perform operations comprising:

identifying time-dependent logging data generated by the second downhole tool in the wellbore after the generation of the depth-dependent logging data, at least one of the depth-dependent logging data or the time-dependent logging data associated with an electric or a magnetic property of the geological formation;

time stamping the generated time-dependent logging data generated by the second downhole tool;

correlating the time stamped time-dependent logging data with the depth-dependent logging data; and based on the correlation, determining at least one of a depth of the second downhole tool in the wellbore or a speed of the second downhole tool in the wellbore.

13. The system of claim 12, wherein the first downhole tool comprises a wireline logging tool or a logging while drilling (LWD) tool.

14. The system of claim 13, wherein the first and second downhole tools either are the same downhole tool or are coupled together in a downhole tool string.

15. The system of claim 12, wherein both of the depth-dependent logging data and the time-dependent logging data are associated with the electric or the magnetic property of the geological formation.

16. The system of claim 15, wherein each of the depth-dependent logging data and the time-dependent logging data comprises at least one of gamma ray logging data or resistivity logging data.

17. The system of claim 12, wherein correlating the time-dependent logging data with the depth-dependent logging data comprises:

determining a range of measurements of the time-dependent logging data;

comparing, for each range of measurements, values in the time-dependent logging data and values in the depth-dependent logging data;

determining, based on the comparison, a correlation quality; and based on the correlation quality exceeding a threshold, determining the depth or the speed of the second downhole tool in the wellbore.

18. A second downhole tool comprising a non-transitory computer-readable storage medium encoded with at least one computer program comprising instructions that, when executed, operate to cause at least one processor of the second downhole tool to perform operations comprising:

identifying depth-dependent logging data stored in computer-readable memory of the second downhole tool, the depth-dependent logging data generated by a first logging tool in a wellbore and associated with a geological formation;

identifying time-dependent logging data generated by the second downhole tool in the wellbore, at least one of the depth-dependent logging data or the time-dependent logging data associated with an electric or a magnetic property of the geological formation;

time stamping the time-dependent logging data generated by the second downhole tool;

correlating the time stamped time-dependent logging data with the depth-dependent logging data; and based on the correlation, deter inning at least one of a depth of the second downhole tool in the wellbore or a speed of the second downhole tool in the wellbore.

19. The second downhole tool of claim 18, wherein the first downhole tool comprises a wireline logging tool or a logging while drilling (LWD) tool.

20. The second downhole tool of claim 18, wherein both of the depth-dependent logging data and the time-dependent logging data are associated with the electric or the magnetic property of the geological formation.

21. The second downhole tool of claim 20, wherein each of the depth-dependent logging data and the time-dependent logging data comprises at least one of gamma ray logging data or resistivity logging data.

22. The second downhole tool of claim 18, wherein correlating, with at least one of the first or second downhole tool, the time-dependent logging data with the depth-dependent logging data stored in the memory comprises:

determining a range of measurements of the time-dependent logging data;

comparing, for each range of measurements, values in the time-dependent logging data and values in the depth-dependent logging data;

determining, based on the comparison, a correlation quality; and based on the correlation quality exceeding a threshold, determining the depth or the speed of the second downhole tool in the wellbore.

23. The second downhole tool of claim 22, wherein determining at least one of a depth of the second downhole tool in the wellbore or a speed of the second downhole tool in the wellbore comprises determining, in real-time, at least one of a depth of the second downhole tool in the wellbore or a speed of the second downhole tool in the wellbore during a running of the second downhole tool into the wellbore.

* * * * *